US012042074B2

(12) United States Patent
Van Beynum et al.

(10) Patent No.: US 12,042,074 B2
(45) Date of Patent: Jul. 23, 2024

(54) BEDDING ASSEMBLY, DUVET COVER AND FIXATION DEVICE

(71) Applicant: CIRCULAIRDREAMS B.V., LE Lisse (NL)

(72) Inventors: Johan Ronald Van Beynum, CH Nijmegen (NL); Henriette Willemina Van Beynum, AP Lisse (NL)

(73) Assignee: CIRCULAIRDREAMS B.V., Lisse (NL)

( * ) Notice: Subject to any disclaimer, the term of this patent is extended or adjusted under 35 U.S.C. 154(b) by 552 days.

(21) Appl. No.: 17/287,206

(22) PCT Filed: Oct. 22, 2019

(86) PCT No.: PCT/NL2019/050694
§ 371 (c)(1),
(2) Date: Apr. 21, 2021

(87) PCT Pub. No.: WO2020/085901
PCT Pub. Date: Apr. 30, 2020

(65) Prior Publication Data

US 2021/0386223 A1 Dec. 16, 2021

(30) Foreign Application Priority Data

Oct. 23, 2018 (NL) ..... 2021857

(51) Int. Cl.
*A47G 9/00* (2006.01)
*A47G 9/02* (2006.01)

(52) U.S. Cl.
CPC ..... *A47G 9/0261* (2013.01); *A47G 9/0207* (2013.01); *A47G 2009/0269* (2013.01)

(58) Field of Classification Search
CPC ..... A47G 9/00; A47G 9/02; A47G 9/0261; A47G 9/0207; A47G 2009/0269
See application file for complete search history.

(56) References Cited

U.S. PATENT DOCUMENTS

| | | | | |
|---|---|---|---|---|
| 2,505,027 A | | 4/1950 | Belsky | |
| 4,163,372 A | | 8/1979 | Frye et al. | |
| 4,662,016 A | * | 5/1987 | Seeman | A47C 21/022 24/72.5 |
| 5,400,478 A | * | 3/1995 | Levinsohn | A47C 21/022 24/523 |
| 8,458,832 B1 | * | 6/2013 | Krishna | A47G 9/0261 5/501 |

(Continued)

FOREIGN PATENT DOCUMENTS

| | | |
|---|---|---|
| CN | 1158303 A | 9/1997 |
| DE | 2611030 A1 | 9/1977 |

(Continued)

*Primary Examiner* — Fredrick C Conley
(74) *Attorney, Agent, or Firm* — PERRY + CURRIER INC.

(57) ABSTRACT

A bedding assembly comprises an at least substantially rectangular insulating coverlet (1), an at least practically fitting sleeve (2) with which the duvet is covered. The sleeve (2) is closed on a first side (3) and open on an opposite side (4) in order to receive the coverlet (1). Provided in or at least close to a first and a second corner on the first side (3) of the assembly are manually releasable fixation means (10) which connect the coverlet (1) to the sleeve (2) in or close to the corners.

11 Claims, 2 Drawing Sheets

(56) References Cited

U.S. PATENT DOCUMENTS

| | | | | |
|---|---|---|---|---|
| 2012/0260425 | A1* | 10/2012 | Pecqueur | A47G 9/0261 5/498 |
| 2015/0327685 | A1* | 11/2015 | Longnecker | A47C 21/022 5/498 |
| 2017/0251840 | A1 | 9/2017 | Reuben | |
| 2018/0192780 | A1* | 7/2018 | Lowe | A47C 21/022 |
| 2020/0060447 | A1* | 2/2020 | Fravel | A47G 9/0261 |

FOREIGN PATENT DOCUMENTS

| | | | |
|---|---|---|---|
| DE | 10311434 | A1 | 9/2004 |
| EP | 1953010 | A2 | 8/2008 |
| FR | 2916334 | A3 | 11/2008 |
| GB | 2461958 | A | 1/2010 |
| GB | 2500593 | A | 10/2013 |
| JP | H0593331 | U | 12/1993 |
| JP | H07027372 | U | 5/1995 |
| JP | 2000342416 | A | 12/2000 |
| JP | 2002253309 | A | 9/2002 |
| JP | 3107996 | U | 1/2005 |
| JP | 3143428 | U | 7/2008 |
| WO | WO-2010075094 | A1 | 7/2010 |

* cited by examiner

BEDDING ASSEMBLY, DUVET COVER AND FIXATION DEVICE

The present invention relates to a bedding assembly comprising an at least substantially rectangular insulating duvet, and an at least practically fitting sleeve with which the duvet is covered, which sleeve is closed on a first side and open on an opposite side in order to receive the coverlet.

Such a bedding assembly is generally known, particularly in the climatologically colder geographic regions, as insulating blanket under which it is possible to sleep. The coverlet can be of varying nature but usually takes a flexible form in order to be able to easily follow the contours of the body in comfortable manner. Use can be made here of a textile blanket which is woven from an optionally natural yarn, such as in particular wool, cotton, and many synthetic fibres. In addition, such materials and others can also be applied in loose form in a surrounding ticking in the form of a so-called duvet. Many materials used for duvets are, in addition to optionally synthetic hollow fibres, many natural materials and fibres such as down, feathers, wool and cotton. The purpose of the coverlet is to retain body heat. From an aesthetic viewpoint as well as a practical and hygienic one the coverlet is normally covered with a sleeve, or cover, which can be easily exchanged for washing or replacement and which gives the bedding an attractive appearance.

Such a cover is normally embodied as a sleeve which matches the rectangular shape of the coverlet. The sleeve is closed at a head end or provided with a (zip) fastening and is open at a foot end so that the coverlet can be inserted therein and the sleeve can be spread over the coverlet. By laying this assembly on a bed, and tucking it in if desired, a bed can be made quickly. Such bedding usually takes a rectangular form with length dimensions of typically 180 to 260 centimetres and typically a width of 80 centimetres, in an embodiment for a single person, and of 160 to 240 centimetres for twin bed use and two-person use.

Although countless people have for years made use of such bedding to their complete satisfaction, it is nevertheless perceived as irritating that during the night the coverlet can migrate within the sleeve. Parts of the assembly are then formed only by the sleeve, whereby at these positions there is no longer any thermal insulation, or hardly so, while at other positions the coverlet will heap together inside the sleeve, which does not enhance comfort.

The present invention has for its object, among others, to provide a bedding assembly which does not have this drawback, or at the least does so to significantly lesser extent.

In order to achieve the stated object a bedding assembly of the type described in the preamble therefore has the feature according to the invention that, in or at least close to a first and a second corner on the first side of the assembly, manually releasable fixation means are provided which connect the coverlet to the sleeve in or close to the corners. The invention is based here on the insight that a migration of the coverlet inside the sleeve can be effectively prevented by a fixation of the coverlet in or close to the corner points at the head end. The coverlet can thus be held particularly in place close to these corners, while with the known duvet it is precisely here that there was the danger of shifting from the proper position. The bedding assembly according to the invention further contributes here toward sleep comfort and a good night's rest for the user. Although the fixation means can in principle also be provided externally, a particular embodiment of the bedding assembly according to the invention has the feature that the fixation means are provided inside the sleeve between the coverlet and the sleeve.

The fixation means can be of diverse nature. What is important is that the connection between the coverlet and the sleeve can be made and broken manually, i.e. with the bare hands, so that the coverlet can be covered in the usual manner with the sleeve. A particular embodiment of the bedding assembly has for this purpose the feature that the fixation means comprise first and second connecting means which are connected in corresponding manner to the sleeve and the coverlet and which mutually co-act in order to bring about a manually breakable connection. Both the coverlet and the sleeve are in that case equipped with a part of the fixation means which together provide for the fixation of the coverlet inside the sleeve.

The connecting means can also be of diverse nature, though a particular embodiment of the bedding is characterized in that the first and second connecting means comprise attaching strips, in particular complementary hook and loop fastening parts, which on a back side are connected permanently to one of the coverlet and the sleeve and are provided on a visible side with manually releasable attaching means.

In order to provide the sleeve and the coverlet in corresponding manner with such connecting means, both the cover and the coverlet have to be adapted for the purpose. This requires a modification of the coverlet as well as of the sleeve and, in some cases, manufacturer harmonization for these separate parts. In order to avoid this, a further preferred embodiment of the bedding assembly according to the invention has the feature that the fixation means comprise a fixation device with a base part which is connected directly or indirectly to the sleeve and has on a free distal end one or more fixation members which are able and configured to receive and fix a free outer end of at least the coverlet. The coverlet thus requires no further modification, and in particular an existing coverlet can also be applied for the purpose so that it does not have to be replaced and/or discarded in order to apply the invention.

The fixation device can be wholly received in the sleeve and permanently attached therein. From a practical viewpoint a particular embodiment of the bedding assembly according to invention has for this purpose the feature that the sleeve comprises a stitched seam on the closed first side and that the fixation device comprises a proximal tongue which protrudes into the stitched seam, in particular is stitched therein. The attachment of the fixation device can thus take place in the same production operation as a closing of the sleeve by means of the stitching, so that no additional steps are required for this purpose. In a first particular embodiment the bedding assembly according to the invention is characterized in this respect in that the fixation device comprises a clamping device which carries at the distal end at least one clamping member into which an edge of at least the coverlet is clamped, and more particularly in that the at least one clamping member comprises a resilient, at least pivoting jaw in which the edge of at least the coverlet is clampingly received. By opening the clamping member, or resilient jaw, this clamping can be released and the coverlet can be removed therefrom or the outer end of the coverlet can be inserted therein in order to be fixedly clamped thereby. The clamping action of the clamping member then provides for the desired fixation of the coverlet.

A particular embodiment of the bedding assembly has the feature here according to the invention that the fixation device comprises a housing with a bay in which the resilient, at least pivoting jaw is received with clamping closure of the jaw round an edge of at least the coverlet. The device thus comprises an assembly of separate parts, in particular each in the form of a monolithic body. The deeper the jaw is introduced into the cavity, the more locked and enclosed it becomes therein, whereby the jaw will close. The jaw thus closes round the edge of at least the coverlet and clamps it fixedly therein. This can be applied externally as well as internally inside the cover.

In the former case the device closes with the jaw over an edge of the whole assembly of cover and coverlet. In the latter case the device is advantageously attached permanently inside the sleeve. With this in mind a further particular embodiment of the bedding assembly has the feature according to the invention that a tongue extends proximally from one of the housing and the jaw, and the tongue is connected to the cover. The tongue is particularly stitched for this purpose into the seam of the cover.

The clamping fixation can be developed wholly by clamping force and the resistance caused thereby. In order to release the clamping, this clamping force has to be overcome manually, for which purpose wings or studs can optionally be provided on the clamping members. A particular embodiment of the bedding assembly has the feature according to the invention that snap members are provided on the at least one clamping member which co-act mutually in order to realize a snap connection while enclosing the edge of at least the coverlet. Release of the snap connection thus suffices to separate the two parts of the bedding assembly and clicking the snap members together suffices to connect the two parts. It is not necessary to overcome clamping force, while the snap connection moreover provides a firmer connection.

A further preferred embodiment of the bedding assembly has the feature according to the invention that the at least one clamping member comprises a number of spatially separated slats which extend from the fixation device and which lie alternately on an upper side and an underside of at least the coverlet. The outer end of at least the coverlet is here threaded through between the fins or fingers of the fixation device. This is found in practice to already result in an effective fixation of the coverlet in the sleeve.

A further contribution is made toward this fixation in a particular embodiment of the bedding assembly which is characterized in that the fins are provided on mutually facing flanks with gripping means. An additional advantage is that a fixation device embodied in such a manner can be given a substantially flat form so that the device will not be discernible in the sleeve, or hardly so, when lied upon. The gripping means can for instance comprise a relief or barbs which are formed on the fins. A friction material or surface treatment can also be applied on the fins for this purpose.

It is preferred from an economic viewpoint to be able to manufacture the fixation device at minimal cost. With this in mind a further particular embodiment of the bedding assembly has the feature according to the invention that the fixation device comprises a monolithic body of one material, in particular a thermoformed body of a thermoplastic material, an extruded body or a punched body.

The invention also relates to a fixation device per se as has been described above, and to a duvet cover comprising a sleeve, wherein in or close to opposite corners located at an at least substantially closed first side the sleeve is provided with fixation means for a manually releasable connection to a duvet to be received in the sleeve.

The invention will be further elucidated hereinbelow with reference to several exemplary embodiments and an accompanying drawing. In the drawing.

Figure 3:
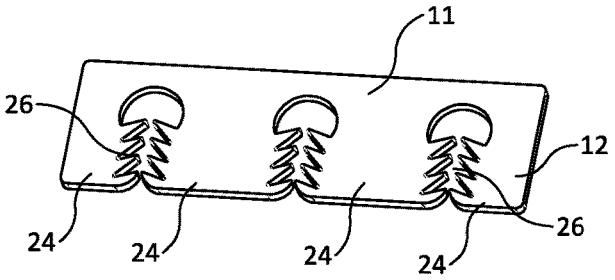
FIG. 3 shows a third exemplary embodiment of a fixation device according to the invention.
Figure 4A:
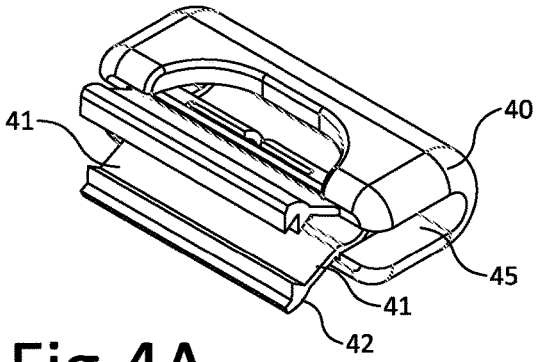
Figure 4B:
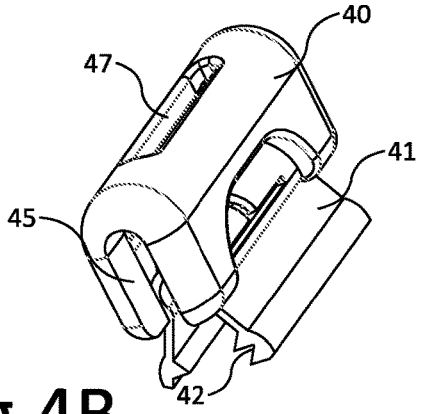
Figure 5A:
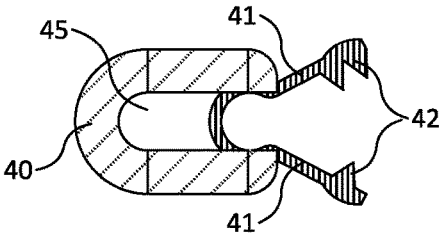
Figure 5B:
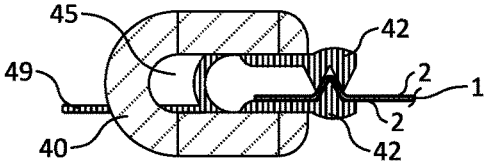
Figure 6:
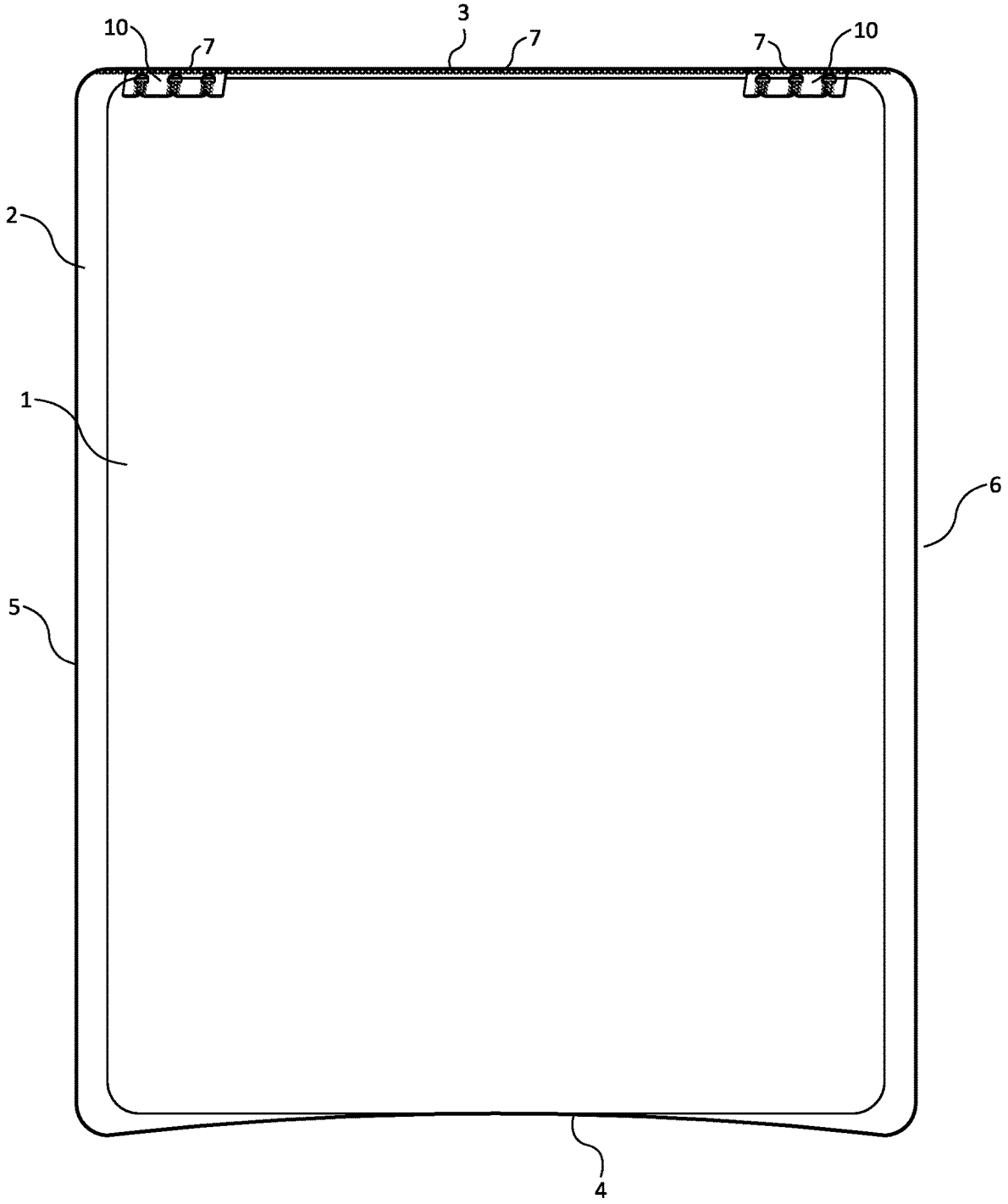

FIGS. 4A/4B show a fourth exemplary embodiment of a fixation device according to the invention;

FIG. 5A shows the fixation device of FIGS. 4A and 4B in opened state;

FIG. 5B shows the fixation device of FIGS. 4A and 4B in closed, clamping state; and FIG. 6 shows an exemplary embodiment of a bedding assembly according to the invention in which the fixation device of FIG. 3 is applied.

It is otherwise noted here that the figures are purely schematic and not always drawn to (the same) scale. Some dimensions in particular may be exaggerated to greater or lesser extent for the sake of clarity. Corresponding parts are designated in the figures with the same reference numeral.

Figure 1:
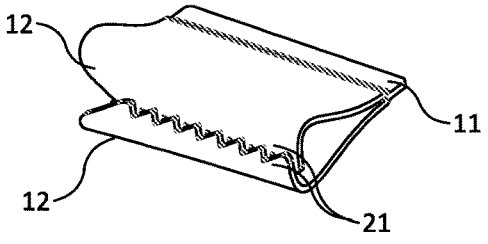
FIG. 1 shows a first exemplary embodiment of a fixation device according to the invention.

FIGS. 1 to 3 show different embodiments of a fixation device according to the present invention such as can be applied advantageously in a bedding assembly according to the invention. This is particularly a coverlet in the form of a duvet which is covered with a duvet cover of cotton, linen or other suitable textile. These embodiments have in common that they all comprise a monolithic body of a suitable plastic such as polyethylene or other thermoplastic, and can thereby be manufactured for instance by means of injection moulding in a single thermoforming operation.

Each of the fixation devices shown in FIGS. 1 to 3 has on a proximal side a planar, relatively flat base part 11 with which it can be secured in a sleeve of a bedding assembly. Base part 11 comprises for instance a flat tongue extending monolithically from the fixation device. The fixation device is advantageously stitched with base part 11 into a hem of the sleeve/duvet cover with stitching, preferably the same stitching as that with which the sleeve/duvet cover has also been closed along a stitched seam at a head end.

On a distal side each of the shown fixation devices is provided with suitable fixation means in which an edge of the duvet can be clamped. In the example of FIG. 1 this is a resilient jaw 12 with a toothing 21 in which an edge of a coverlet, such as duvet, of the bedding can be received. Resilient jaw 12 grips round the edge of the duvet and exerts a clamping force thereon in order to thus fix the duvet in the duvet cover. Toothing 21 arranged on the jaw provides here for extra grip and likewise an extra-strong fixation. In order to free the duvet from jaw 12, the jaw can be opened manually with the bare hands in order to thus release the duvet.

Figure 2A:
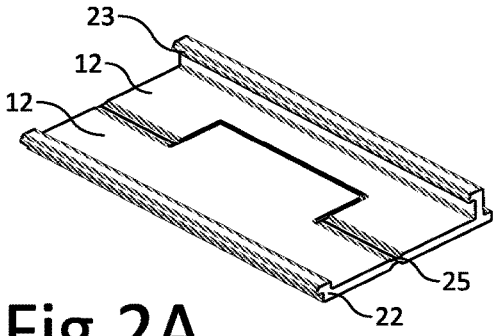
FIG. 2A shows a second exemplary embodiment of a fixation device according to the invention in open state.
Figure 2B:
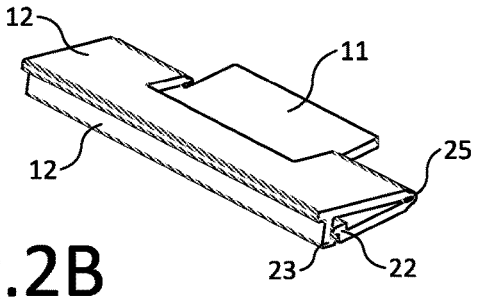
FIG. 2B shows a second exemplary embodiment of a fixation device according to the invention in closed state.

An alternative embodiment is shown in FIGS. 2A and 2B. In this case the fixation device comprises a jaw of approximately two halves 12 mutually connected by a film hinge 25. Film hinge 25 is formed here by an intentional thickness reduction of the material over a width of the body. The fixation device is thus also formed in this case by a single monolithic body, wherein film hinge 25 allows both halves 12 thereof to pivot toward each other. A relatively flat tongue 11 formed on one of the halves 12 also provides in this case for a proximal attachment base with which the device can be secured, in particular stitched, in a duvet cover or the like.

On a distal side both parts 12 of the device of FIGS. 2A/2B are provided with mutually co-acting snap members 22,23. By moving the device from the open state shown in FIG. 2A to the closed state shown in FIG. 2B while overcoming a resistance of the mutually co-acting snap members 22,23 the device can be manually clicked shut and, vice versa, also manually opened again. Snap members 22,23 are dimensioned here such that they allow an edge of a coverlet, such as a duvet, to be clamped therebetween while the snapping action is maintained. The coverlet can thus be fixed efficiently at the edge in an enveloping cover.

FIG. 3 shows a wholly planar, flat embodiment of a fixation device according to the invention. In addition to being formed by means of injection moulding, this device can if desired also be formed for instance by being punched from a sheet material or being removed from an extruded body. A relatively flat base part 11 on a proximal side also provides in this case for an attachment base with which the device can for instance be stitched into a seam or elsewhere inside a textile sleeve which will envelop a coverlet.

On a distal side the device comprises a number of successive fins or fingers 24 spatially separated from each other. The intermediate spaces 26 therebetween allow an edge of a duvet to be received therein. The edge of the duvet is received alternately on and under the fins/fingers 24 and is thus threaded therebetween. This achieves a fixation of the duvet in the device which avoids migration of the duvet in the cover during use. This is further enhanced by a toothing which is arranged on the fins and which will exert extra grip on the edge of the duvet.

Shown in FIG. 6 is an embodiment of a bedding assembly equipped with a set of the fixation devices shown in FIG. 3. The bedding assembly comprises a normal, non-modified duvet 1 of a suitable size with a duvet cover 2 fitting thereover. The cover is closed at a first end surface 3, but is open at an opposite side 4 so that duvet 1 can be introduced therein. The closed first side 3 will normally be used as head end.

Fixation devices 10 are arranged close to opposite corners of the closed first end surface 3. The two fixation devices 10 are in this case located at the first end surface 3 of the cover, although it is also possible instead to opt for a position close to the respective corner on a longitudinal side 5,6 with which the first side 3 forms the corner. End surface 3 will generally comprise stitching 7 with which an upper side and a back side of the cover are sewn to each other so as to thus form a sleeve. A proximal base part 11 of each device 10 advantageously lies in this stitched seam and the devices are thus connected permanently and firmly to duvet cover 2.

An edge of the duvet 1 is threaded through the intermediate spaces 26 between the fins or fingers 24 of fixation device 10, see also FIG. 3. The fins thus lie alternately on an upper side and a back side of duvet 1 and fix the duvet between fingers 24, and thereby fix duvet 1 inside cover 2. The toothing provided on fingers 24 provides for extra grip and thus contributes toward this fixation. Migration of the duvet in the cover during use is thus effectively prevented, which enhances sleep comfort.

The fixation device according to the invention can also be arranged externally instead of inside the duvet cover. FIGS. 4A and 4B show a particular embodiment of the fixation device which can be applied for this purpose. This fixation device comprises a housing 40 with a recess 45 in which a resilient, at least pivoting jaw 41 is movable. Jaw 41 carries on its outer end a toothing 42 for the purpose of additional grip on duvet assembly 1,2.

In the open state shown in FIG. 5A an edge of duvet cover 2 with duvet 1 therein is placed inside jaw 41. Jaw 41 is subsequently pushed inside recess 45, whereby the jaw will close. The dimensions of jaw 41 and recess 45 are adapted to each other here such that the jaw will grip here round the edge of the duvet cover with the duvet therein and will fixedly clamp the whole, as shown in FIG. 5B. The duvet now lies fixed inside the cover. Housing 40 and jaw 41 of the device preferably each comprise a monolithic body of a suitable plastic, such as polyethylene or polypropylene. In addition to being formed by injection moulding, both parts can also be formed by means of extrusion and for instance be detached from a greater length. A greater wall thickness is advantageously applied for housing 40 for the purpose of a desired dimensional stability and rigidity. The jaw 41 on the other hand is kept relatively thin at the location of the hinge therein in order to allow a flexible jaw action of the wings of the jaw. Different plastics can optionally be applied for the two parts, i.e. the housing and the jaw, of the device so as to be optimally suitable for the respective functions thereof.

Jaw 41 can be pushed laterally as well as from the front into recess 45 of housing 40. A frontal insertion has the advantage here that a lateral displacement of duvet 1 in duvet cover 2 is avoided. On the front of the recess a transverse rib, shoulder or set of protrusions can optionally be provided here which preferably extends inward from either side (i.e. from above and from below) in order to lock the jaw therebehind and fix it in the recess. In the case of a front insertion the jaw will in that case snap behind the respective rib(s), shoulder(s) or protrusions, whereby a discernible, i.e. tangible and audible, fixation is obtained.

Although the device shown in FIGS. 4A-5B can in principle also be applied externally, it is preferably provided internally. A flat extension, in the form of for instance the tongue 49 further shown in FIG. 5B, can be provided proximally here which, as well as extending from jaw 41, can if desired extend from housing 40 as shown here. In the former case jaw 41 protrudes movably with tongue 49 through a gap 47 provided for the purpose in housing 40. Such a tongue 49 can, in similar manner as base part 11 of the embodiments of FIGS. 1-3, be secured (stitched) in a seam of the cover so that fixation device 40,41 thus lies inside the duvet cover so as to receive an edge of the duvet in the manner described above for the assembly.

Although the invention has been further elucidated above with reference to only several exemplary embodiments, it will be apparent that the invention is by no means limited thereto. On the contrary, many variations and embodiments are still possible within the scope of the invention for a person with ordinary skill in the art.

Instead of one or more of the shown fixation devices, use can also be made for the fixation of a duvet inside a cover of differently designed fixation devices, which may or may not be of one material. Instead of being formed from plastic, a fixation device can also be formed from a metal or a natural material such as wood, rubber or bamboo. Other attaching or connecting means are also suitable within the scope of the invention, such as for instance semi-permanently attaching fastening strips arranged on overlapping parts in corresponding manner in the cover and the duvet.

Nor is the invention limited to use with duvets usually assembled from a textile ticking with a loose material inside such as cotton, wool, down or feathers. The invention can likewise be applied in combination with a woven, non-woven or otherwise assembled blanket or coverlet. The invention generally provides a solution to unintended migration of a coverlet inside a sleeve with which the coverlet is enveloped.

The invention claimed is:

1. Bedding assembly comprising an at least substantially rectangular insulating coverlet, an at least practically fitting sleeve with which the coverlet is covered, which sleeve is closed on a first side and open on an opposite side in order to receive the coverlet, wherein manually releasable fixation means are provided in or at least close to a first and a second corner on the first side of the assembly, which connect the coverlet to the sleeve in or close to the corners, wherein the fixation means are provided inside the sleeve between the coverlet and the sleeve; wherein the fixation means comprise a fixation device with a base part which is connected directly or indirectly to the sleeve and has on a free distal end one or more fixation members which are able and configured to receive and fix a free outer end of at least the coverlet; wherein the fixation device comprises a clamping device which carries at the distal end at least one clamping member into which an edge of at least the coverlet is clamped;

wherein the at least one clamping member comprises a resilient, at least pivoting jaw in which the edge of at least the coverlet is clampingly received;

wherein the fixation device comprises a housing with a recess in which the resilient, at least pivoting jaw is received with clamping closure of the jaw round an edge of at least the coverlet; wherein a tongue extends proximally from one of the housing and the jaw, and wherein the tongue is connected to the cover.

2. The bedding assembly as claimed in claim 1, wherein the sleeve comprises a stitched seam on the closed first side; and that wherein the tongue protrudes into the stitched seam.

3. The bedding assembly as claimed in claim 2, wherein the tongue is stitched into stitched seam.

4. The bedding assembly as claimed in claim 1, wherein the fixation device comprises a monolithic body of one material, in particular a thermoformed body of a thermoplastic material, an extruded body or a punched body.

5. The duvet cover comprising a textile sleeve, wherein in or close to opposite corners located at an at least substantially closed first side the sleeve is provided with fixation means for a manually releasable connection to a duvet to be received in the sleeve, as applied in de bedding assembly of claim 1.

6. The fixation device of the type as applied in the bedding assembly as claimed in claim 1.

7. Bedding assembly comprising an at least substantially rectangular insulating coverlet, an at least practically fitting sleeve with which the coverlet is covered, which sleeve is closed on a first side and open on an opposite side in order to receive the coverlet, wherein manually releasable fixation means are provided in or at least close to a first and a second corner on the first side of the assembly, which connect the coverlet to the sleeve in or close to the corners, wherein the fixation means are provided inside the sleeve between the coverlet and the sleeve; wherein the fixation means comprise a fixation device with a base part which is connected directly or indirectly to the sleeve and has on a free distal end one or more fixation members which are able and configured to receive and fix a free outer end of at least the coverlet; wherein the fixation device comprises a clamping device which carries at the distal end at least one clamping member into which an edge of at least the coverlet is clamped; and wherein the at least one clamping member comprises a number of spatially separated fins which extend from the fixation device and which lie alternately on an upper side and an underside of at least the coverlet.

8. The bedding assembly as claimed in claim 7, wherein the fins are provided on mutually facing flanks with gripping means.

9. The bedding assembly as claimed in claim 7, wherein the fixation device comprises a monolithic body of one material, in particular a thermoformed body of a thermoplastic material, an extruded body or a punched body.

10. The duvet cover comprising a textile sleeve, wherein in or close to opposite corners located at an at least substantially closed first side the sleeve is provided with fixation means for a manually releasable connection to a duvet to be received in the sleeve, as applied in de bedding assembly of claim 7.

11. The fixation device of the type as applied in the bedding assembly as claimed in claim 7.

* * * * *